US010814348B2

(12) United States Patent
Hart et al.

(10) Patent No.: US 10,814,348 B2
(45) **Date of Patent: *Oct. 27, 2020**

(54) DISCRETE DEPOSITION OF PARTICLES

(71) Applicants: Massachusetts Institute of Technology, Cambridge, MA (US); UNIVERSITY OF MICHIGAN, Ann Arbor, MI (US)

(72) Inventors: Anastasios John Hart, Woburn, MA (US); Justin Douglas Beroz, Gaithersburg, MD (US); Homayoon Maghsoodi, Okemos, MI (US)

(73) Assignees: MASSACHUSETTS INSTITUTE OF TECHNOLOGY, Cambridge, MA (US); UNIVERSITY OF MICHIGAN, Ann Arbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/949,040

(22) Filed: Apr. 9, 2018

(65) Prior Publication Data

US 2018/0361423 A1 Dec. 20, 2018

Related U.S. Application Data

(63) Continuation of application No. 14/562,631, filed on Dec. 5, 2014, now Pat. No. 9,937,522.

(60) Provisional application No. 61/912,202, filed on Dec. 5, 2013.

(51) Int. Cl.

| | |
|---|---|
| ***B05D 1/12*** | (2006.01) |
| ***B05B 5/00*** | (2006.01) |
| ***B05B 5/025*** | (2006.01) |
| ***B05B 12/06*** | (2006.01) |
| ***B05D 3/14*** | (2006.01) |
| *B05D 1/06* | (2006.01) |

(52) U.S. Cl.

CPC ..... *B05D 1/12* (2013.01); *B05B 5/006* (2013.01); *B05B 5/0255* (2013.01); *B05B 12/06* (2013.01); *B05D 3/14* (2013.01); *B05D 1/06* (2013.01); *B05D 2401/32* (2013.01)

(58) Field of Classification Search

None

See application file for complete search history.

(56) References Cited

U.S. PATENT DOCUMENTS

| | | | | |
|---|---|---|---|---|
| 5,792,380 | A * | 8/1998 | Wen | B41J 2/17509 106/31.32 |
| 9,937,522 | B2 * | 4/2018 | Hart | B05D 1/12 |
| 2001/0035700 | A1 * | 11/2001 | Percin | B05B 17/0607 310/324 |
| 2005/0099456 | A1 * | 5/2005 | Higa | B41J 2/14145 347/44 |
| 2006/0194056 | A1 * | 8/2006 | Nagashima | C09B 67/0084 428/403 |
| 2013/0095469 | A1 * | 4/2013 | Koltay | G01N 15/1404 435/3 |

* cited by examiner

*Primary Examiner* — Shamim Ahmed
*Assistant Examiner* — Bradford M Gates
(74) *Attorney, Agent, or Firm* — Steptoe & Johnson LLP

(57) ABSTRACT

A particle can be discretely ejected from a orifice.

20 Claims, 13 Drawing Sheets

DISCRETE DEPOSITION OF PARTICLES

CLAIM OF PRIORITY

This application is a continuation of U.S. application Ser. No. 14/562,631, filed on Dec. 5, 2014, now U.S. Pat. No. 9,937,522, which claims priority to U.S. Provisional Patent Application No. 61/912,202, filed Dec. 5, 2013, each of which is incorporated by reference in its entirety.

FEDERALLY SPONSORED RESEARCH OR DEVELOPMENT

This invention was made with Government support under Grant No. CMMI 1150585 awarded by the National Science Foundation. The Government has certain rights in the invention.

FIELD OF THE INVENTION

The invention relates to depositing particles.

BACKGROUND

Direct-write printing has enabled the rapid growth of the flexible and organic electronics industries. However, the spatial resolution of dominant printing technologies such as inkjet is insufficient to fabricate high-performance devices. In addition, printing methods that result in random distributions of solid materials on a substrate limit feature geometry and performance.

SUMMARY

Particles can be individually placed on a surface by controlling particle ejection from an orifice. The control can be implemented by adjusting local electric or magnetic fields at or near the point of ejection.

In one aspect, a method of delivering a particle can include providing a liquid including a particle to an exit orifice, sensing a condition at a meniscus of the liquid at the orifice, and applying an electromagnetic signal near the orifice for timed particle ejection based on the sensed condition to deliver the particle from the orifice after applying the electromagnetic signal.

In certain embodiments, the electromagnetic signal can include an electric signal, a magnetic signal, or a combination thereof. In other embodiments, the electromagnetic boundary condition can be an electric boundary condition, a magnetic boundary condition, or a combination thereof.

In certain embodiments, the electromagnetic signal can be AC or DC. The electromagnetic signal can be constant or varying. A single particle can be specifically printed.

In certain embodiments, the method can include sensing an electromagnetic boundary condition. The method can include sensing a liquid flow boundary condition. The method can include applying an electromagnetic signal pulse.

In certain embodiments, the particle can be a solid having a size of less than 100 μm. The particle can be a solid having a size of less than 10 μm. The particle can be a solid having a size less than 1 μm. The particle can be a solid having a size of less than 100 nm. The particle can include polymer. The particle can include metal. The particle can include ceramic. The particle can include an organic crystal. The particle can be conductive. The particle can include semiconductor material.

In certain embodiments, the orifice can expose the liquid meniscus from which a particle is ejected. The orifice can have an opening larger than the particle diameter. The opening of the orifice can have a diameter of at least ten times of the diameter of the particle. The opening of the orifice can have a diameter of at least 100 times of the diameter of the particle. The opening of the orifice can have a diameter of at least 1000 times of the diameter of the particle.

In certain embodiments, the method can include annealing the particle. The method can include printing particles in arrays. The method can include printing particles in lines. The method can include printing a two-dimensional pattern. The method can include printing a vertical stack. The method can include printing a three-dimensional pattern.

In another aspect, a device of delivering a particle can include an orifice, a liquid including a particle to an exit orifice, a sensor capable of sensing a condition at a meniscus of the liquid at the orifice, and an electromagnetic supply configured to generate an electromagnetic field near the orifice.

In certain embodiments, the device can include an array of print nozzles. The device can print particles of different sizes. The device can print particles of different materials. The device can print a two-dimensional pattern comprising heterogeneous materials. The device can print a three-dimensional pattern comprising heterogeneous materials.

In another aspect, a device of delivering a particle can include a liquid containing one or more particles, an orifice through which a single particle is ejected from the liquid, and an electromagnetic supply configured to generate an electromagnetic field near the orifice.

In certain embodiments, applying a signal near the orifice can include applying the signal between the orifice and substrate, between the orifice and the surrounding environment, or between liquid and substrate (for example, using a needle in the top of capillary). In this context, near the orifice, can mean proximal to, adjacent to, or through the orifice. In other embodiments, at a meniscus of the liquid can be near the apex of the meniscus. In other embodiments, the particle can be delivered to a space, for example, a drug delivered to an airstream.

In certain embodiments, exactly one particle can be delivered at a time.

Other aspects, embodiments, and features will be apparent from the following description, the drawings, and the claims.

BRIEF DESCRIPTION OF THE DRAWINGS

FIG. 1A shows that Inkjet technologies generate droplets by applying a mechanical pressure pulse to the carrier liquid, which causes a stochastic number of particles to be encapsulated, with random final organization due to droplet spreading; FIG. 1B shows that DPE applies a voltage potential to locally eject an individual particle from the carrier liquid, resulting in deterministic printing of the solid object.

DETAILED DESCRIPTION

Direct-write printing has enabled the rapid growth of the flexible and organic electronics industries; however, the spatial resolution of dominant printing technologies such as inkjet is insufficient to fabricate high-performance devices. As a result, additional processing steps are used to increase printing resolution while sacrificing device density, further miniaturization and cost-reduction is limited, and the opportunity to print functional materials from a growing library of colloidal inks is not fully realized. To resolve these problems, Deterministic Particle Ejection (DPE) can be used for high-speed digital printing. DPE can print virtually any solid object capable of being suspended in a liquid, spanning from nanometers to micrometers in size. These objects could be particles of polymers, metals, or ceramics; intricate chemically made crystals; or miniature chiplets containing lithographically fabricated devices. DPE can print within the 0.1-100 μm size range and make and characterize micron-scale conductive lines and arrayed organic light emitting crystals.

Examples of Printing Technologies

There is a growing need for innovative printing technologies that can leverage a rapidly expanding library of commercially available discrete micro- and nanoscale objects. These printable objects include well-established dispersions of ink and toner particles, new particle formulations such as semiconductor and metal nanoparticles, engineered molecules for organic crystals, biochemically specific beads, and even miniature electronic components ("chiplets") released en masse from silicon wafers. See, for example, Stewart, M. E., Chemical Reviews, 108(2), pp. 494-521; Knuesel, R. J., et al., Proceedings of the National Academy of Sciences of the United States of America, 107(3), pp. 993-998, each of which is incorporated by reference in its entirety. Many of these objects (from complex molecules to chiplets) can now be bulk-manufactured in large quantities with excellent dimensional resolution at low cost. However, means of their placement are limited to approximate methods such as solution casting or droplet printing, which intrinsically result in stochastic organization or require the use of costly substrate pre-patterning methods to enhance registry and/or resolution to meet the needs of electronics manufacturing. For these reasons, practically unlimited possibilities exist for the design of new devices, surfaces, and bulk materials via the capability to organize discrete micro- and nanoscale objects in an efficient and scalable manner.

Figure 1A:
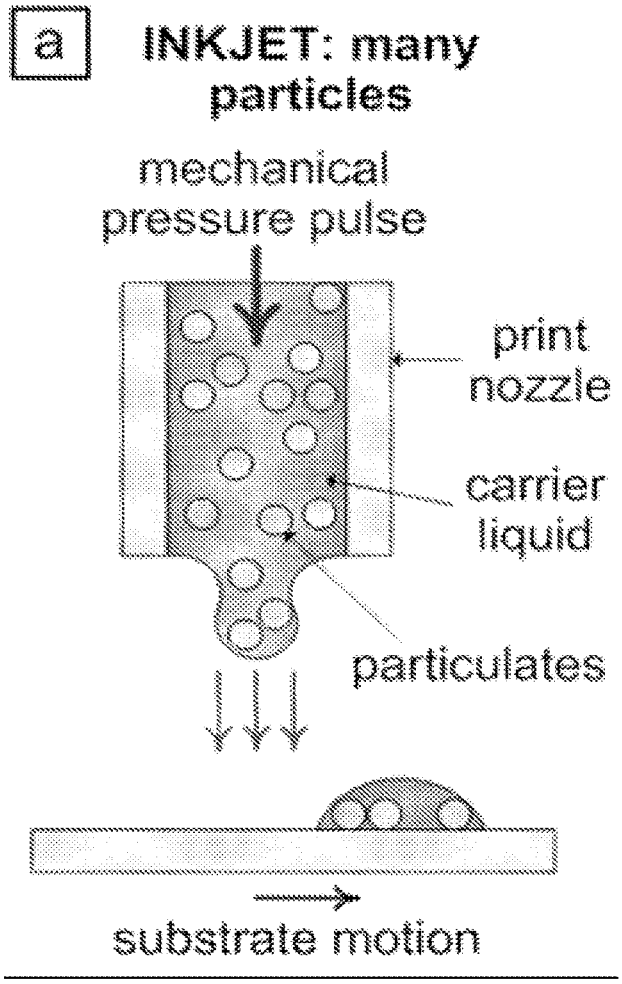
FIGS. 1A and 1B show comparisons of inkjet and proposed Deterministic Particle Ejection (DPE) printing methods.

The potential impact of new printing technologies is demonstrated by the synergetic advancement of inkjet printing (FIG. 1A) and associated functional inks. Inkjet printing is a type of printing that creates a digital image by propelling droplets of ink onto paper, plastic, or other substrates. See, for example, U.S. Pat. Nos. 4,620,196; 5,757,400; U.S. Patent Application Publication No. 20050174385; U.S. Patent Application Publication No. 20060187266; U.S. Pat. Nos. 8,372,731; 8,113,648; U.S. Patent Application Publication No. 20080211866; U.S. Patent Application Publication No. 20090314344; U.S. Pat. Nos. 8,334,464; 5,907,338, each of which is incorporated by reference in its entirety. The combined low-cost and versatility of inkjet has made it the key enabler for printed electronics, and is primarily driven by the largest overlapping consumer application—organic light-emitting diode (OLED) displays and lighting. See, for example, IDTechEx, Printed Electronics Equipment 2013-2018, which is incorporated by reference in its entirety. Printed electronics is also supported by materials manufacturing industries, most notably for development of conductive inks for printing electrical interconnects, as well as functional organic inks for printing a variety of functional device architectures. Other emerging printed electronic applications include RFID and bioprinting/assays.

Figure 2:
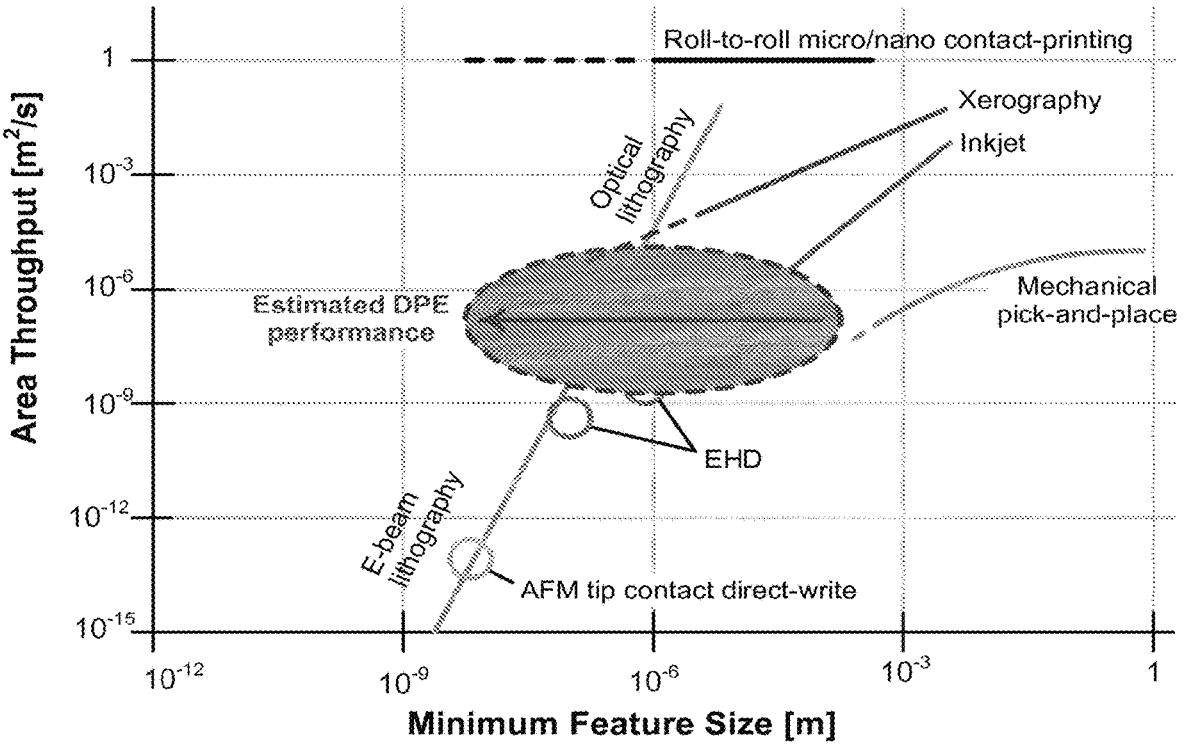
FIG. 2 shows performance of existing printing and lithography technologies, and the DPE process utilizing electrohydrodynamic particle ejection. Solid lines represent realized performance, and dotted lines represent direction/goal of current research. DPE can controllably place solid objects spanning several scale orders, and that unlike alternative methods including inkjet, the areal throughput of DPE can be invariant with particle size.

A performance summary of inkjet and other commercial printing technologies is provided in FIG. 2 and key attributes of each are listed in Table 1. As shown (FIG. 2), inkjet printers used in manufacturing operations typically achieve a smallest spot size or linewidth of ~100 μm and maximum print speed of ~20 kHz (20,000 spots per second, limited by acoustic frequencies for transmission of mechanical pressure through liquids). See, for example, Derby, B., 2010, Annual Review of Materials Research, Vol 40, D. R. Clarke, M. Ruhle, and F. Zok, eds., Annual Reviews, Palo Alto, pp. 395-414, which is incorporated by reference in its entirety. Inkjet is fundamentally limited from printing at smaller length scales by the mechanics of microscale liquid droplet formation (i.e., capillary forces), and by droplet spreading on the substrate. The ultimate limits for inkjet detailed in the academic literature are ~10 μm and this is only achieved for particular liquid/substrate combinations, and based on expert reviews is unlikely to soon be practical for manufacturing.

TABLE 1

| Overview of some printing methods for flexible and organic devices | |
|---|---|
| **Pick-and-Place** | |
| Technology description | Components are mechanically "picked and placed' onto substrates, such as surface-mount electronic components onto circuit boards. |
| Resolution Limits | 100 × 100 μm - Pick-and-place of smaller objects is excessively difficult due to surface forces, such as stiction and electrostatic charging |
| Cost | High - requires high-speed high-precision machines that are expensive and require maintenance |
| Versatility | High - easily re-programmed to place any object >100 × 100 μm in the desired location and orientation. |
| **Inkjet** | |
| Technology description | Droplets of a carrier liquid are ejected from a reservoir through a small orifice using mechanical or thermal transduction. |
| Resolution Limits | ~10 μm - Capillarity, fluid splashing/spread, fluid viscosity, acoustic frequency for pressure transmission. |
| Cost | Low - comparatively inexpensive systems, using batch MEMS-fabricated print heads |
| Versatility | High - any particulate that can be dispersed into a carrier liquid can be printed |
| **Contact Printing** | |
| Technology description | Patterned stamp rollers are "inked" then pressed against the substrate for pattern transfer, such as with 'flexographic printing' |
| Resolution Limits | ~1 μm - fabrication quality of stamp features by lithography and micromachining; and capillarity, fluid wicking, fluid viscosity |
| Cost | Low - machines are large & expensive to purchase, although this is offset by high throughput and low operating costs when printing large quantities of one pattern. |
| Versatility | Low - to print a new pattern, new imprint stamps must be fabricated, which are expensive. |
| **Xerography** | |
| Technology description | Electrostatic charge is patterned onto a transfer drum, attracting charged toner particles. The drum is then pressed against the substrate for pattern transfer. |
| Resolution Limits | ~1 μm - Local confinement of charge accumulation on substrate, limited particle types since charge gathering ability is critical to transfer to substrate |
| Cost | Low - inexpensive and easy to implement. |
| Versatility | Low - only prints particles with the proper charge-accumulation properties. |

However, for many flexible and organic devices, the critical dimensions are on the order of 1 μm for both organic and metallic circuitry. Therefore, to manufacture functional devices, inkjet is often combined with optical lithography and other patterning processes, enabling micron-scale resolution where necessary. This results in increased manufacturing complexity and cost, and often limits the areal density of features (due to the larger size of the sacrificial inkjet templates).

Electrohydrodynamic (EHD) can print liquid droplets, where an applied electromagnetic field, rather than a mechanical pressure pulse, is used to eject liquid droplets from a dispenser nozzle. See, for example, EP1948854B1; U.S. Pat. Nos. 5,838,349; 6,154,226; US20110187798; US20120105528; Park, J. U., et al., 2007, "High-resolution electrohydrodynamic jet printing," Nature Materials, 6(10), pp. 782-789; Chen, C. H., et al., Applied Physics Letters, 88(15), page 3, each of which is incorporated by reference in its entirety.

Other technologies such as xerographic printing suffer from analogous limitations governed by the stochastic accumulation of patterned charge. And, at the opposite extreme of versatility, semiconductor and imprint lithography now enable sub-50 nm patterning, but the high cost of pattern generation and the limited material set does not make this technology deployable beyond the integrated circuit and MEMS industries.

In addition, current printing methods result in random distributions of solid materials on the substrate which limits feature geometry and performance. Therefore, "pain" in direct-write printing, where inkjet is the dominant technology, is that higher feature resolution and throughput are needed (and highly sought-after) for improving the performance of printed electronic devices comprising metallic, semiconducting, and organic solid constituents.

Deterministic Particle Ejection (DPE)

Figure 1B:
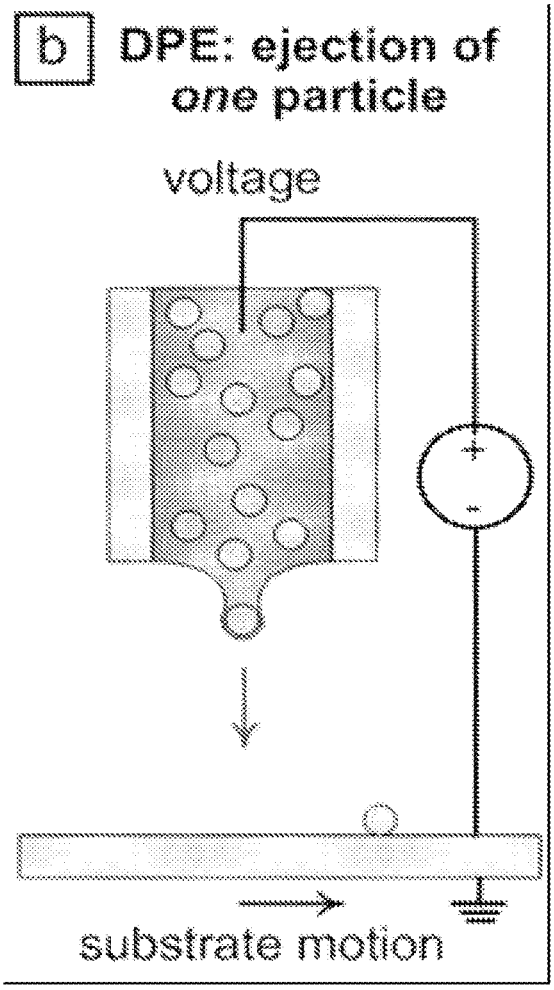

Deterministic ejection of individual particles from a random dispersion can be achieved with DPE. The particles can be in a single file inside a structure, such as a capillary tip. The particles can be ejected through a particle funneling or alignment method. The ejection can be due to physical constraint, like a capillary tip, or by an applied field, such as an electromagnetic field. DPE, a direct-write printing technology, operates by ejection of individual particles from a confined liquid meniscus. DPE enables micron- and sub-micron resolution printing of virtually any solid object, and can be capable of 10-100× smaller feature sizes (e.g., dots, lines) than industrial inkjet printing. Each printing can deliver exactly one particle onto the target substrate (FIG. 1B).

DPE operates by application of a voltage to a liquid held in a capillary tip. This causes ejection of a submerged particle near the liquid-air interface (FIG. 1B). Sensing and control scheme that determines, in real-time, a particle's location near the apex of the meniscus, can be developed before applying a voltage pulse for timed particle ejection.

Several strategies can achieve control of particle ejection. The strategies can include local electric (or magnetic) field concentration near the apex of liquid meniscus ensuring singular particle ejection. This may be achieved by choosing the appropriate electrode configuration inside and outside the liquid, by application of AC or DC field. This can be a passive approach, where particle positioning is guaranteed given the proper 'wait time' between voltage pulses for printing. The field gradient may also be utilized to draw a particle to the proper location for ejection.

The strategies can include optical feedback, using machine-vision, to identify and track the location of particles inside the liquid. When a particle is identified as at the right location for ejection, a voltage pulse command can be issued. This can be a computationally intense approach that may limit print speed.

The strategies can include direct measurement of the electrical signature at the apex of the meniscus cone using a micro voltage probe. When the electromagnetic signature of a particle is sensed, a voltage pulse command can be issued to eject the particle in the vicinity of the probe.

The strategies can include physical entrapment or delivery of a particle to the apex of the liquid meniscus by a stationary or actuated mechanical probe, and/or by a micro- or nanofluidic channel or device. The method of entrapment or delivery may include applying a secondary electrical signal, such as a potential difference, within the liquid meniscus, where the potential difference can be time-varying.

A further strategy may use a physical or chemical process, such as a crystallization or polymerization reaction, to also form the particles within the meniscus, or in proximity to the meniscus or to the delivery means. The particles could be therefore synthesized on demand as printing events are executed and controlled, and the characteristics of the particles could be chosen as necessary.

DPE is distinct from existing EHD printing methods. For example, DPE can involve the ejection of individual solid particles rather than the ejection of a liquid droplet optionally containing a stochastic number of particles, and the particles can be significantly smaller than the diameter of the capillary tip thus enabling clog-free printing of particles. The latter point enables cost-effective micro-nozzle arrays for eventual high-throughput printheads. The particle can be wet, such that a liquid contacts a portion of the surface of the particle. The particle can include a liquid portion, which can have a volume substantially smaller than the solid particle volume.

Electronics and optics can be used for controlling, sensing, and imaging the process. For example, high-precision motorized actuators can be used for programmable positioning of the capillary tip, custom machining can be used to enable exchangeable dispensing tips, and high-speed sensitive electronic circuitry can be used to measure printing process parameters. Hardware components for DPE printing can include a liquid reservoir, dispensing orifice, electrode configuration, and a voltage source. Certain features of the hardware and methods can enable controllable sensing and ejection of individual particles from the liquid meniscus. Microfabricated nozzle arrays can be as printheads for DPE. In contrast, bulky capillary tube delivery systems have been used in multi-tip EHD liquid printers. A method of forming conductive lines can include heating chains of individually arranged particles. DPE can also be used to prepare OLED architectures featuring printed micro-crystals and/or stacked particulate elements.

Key process parameters and attributes (i.e., voltage pulse profile, particle ejection velocity and trajectory, power consumed per print, etc.) can be determined, and derive experimental scaling laws for DPE printing (e.g., speed and voltage versus size and particle conductivity) can also be determined.

Threshold voltage to eject a particle as a function of the particle-to-capillary diameter ratio and particle-to-meniscus liquid gap (i.e., distance 'δ' labeled in FIG. 3B) can be determined, which can provide a quantitative design guide for the process parameter values that enable particle ejection. Particle can be sensed and delivered by measuring a local change in electrical impedance or resistivity of the liquid at the apex of the meniscus, indicating the arrival of a particle for printing.

An analytical model capturing the local ejection of a single particle can be derived. Arbitrary particle-liquid combinations and printer configurations desirable for specific applications can be developed. The particle ejection physics can be determined by local conditions between a single particle and nearby liquid interface, and therefore the model can be adapted to different tip designs and can be independent of the particle concentration away from the tip.

Figure 4A:
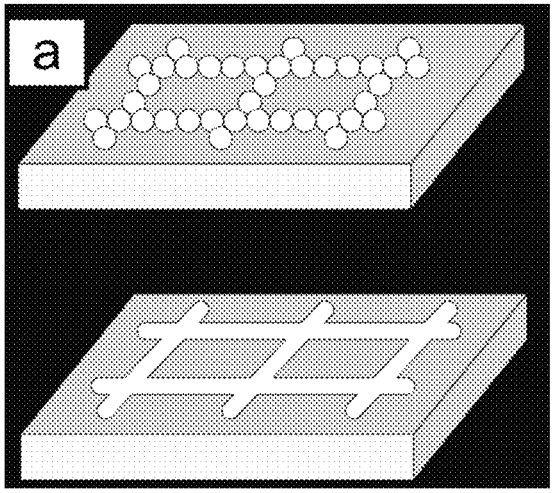
FIG. 4A shows a design for particle line patterns that can be annealed to for micron-scale conductive traces.

DPE printer can print discrete particulates from 0.1-100 μm, such as 1-μm diameter, from an orifice, such as a glass capillary tip. DPE printer can print discrete particulates from 1-100 μm; DPE printer can print discrete particulates from 0.1-1 μm. DPE can print not only one-dimensional structures, but also two-dimensional or three-dimensional structures. For example, DPE can print metallic particle (~1 μm) lines and grid arrays, and organic crystals (0.5-50 μm). In addition, DPE can print 1-10 μm wide conductive lines on substrates, by printing individual conductive (metallic or carbon) particles (1-10 μm diameter) in line patterns, followed by an annealing step (i.e., heating) to fuse the particles into solid conductive traces (FIG. 4A).

During DPE printing, a condition near the apex of a meniscus of the liquid at the orifice can be sensed. The condition can be an electrical boundary condition and/or a liquid flow boundary condition by near the apex of a meniscus of the liquid at the orifice. The condition can be sensed by by detecting the location of the particle near the apex of a meniscus of the liquid at the orifice. The condition can be sensed by measuring electrical properties of the liquid.

During DPE printing, an electromagnetic signal can be applied. The electrical signal can be AC or DC; the electromagnetic signal can be either constant or slowly varying with respect to print dynamics. A profiled electrical signal pulse on the timescale of particle ejection dynamics can be applied and may be or superimposed on the applied electrical signal. A voltage pulse can be applied. An alternative is to apply s constant bias voltage, which can cause repeatable and regularly timed printing of individual particles.

For DPE printing, particles can be supplied in different ways. For example, particles can travel within the liquid towards the meniscus, where it is ejected when sufficiently close. In another approach, a discrete number of the particles can be supplied directly onto the meniscus, from which they are ejected once at the proper location.

The particles can be printed in arrays, lines, or vertical stacks. DPE can print an arbitrary two-dimensional pattern; DPE can print an arbitrary three-dimensional pattern. The arrays, lines or stacks can be annealed. The two-dimensional pattern or the three-dimensional pattern can be annealed. DPE can also deliver exactly one particle. A particle printed by DPE can be used for building an electronic or optical component or device, such as a component of a silicon device wafer.

Figure 4B:
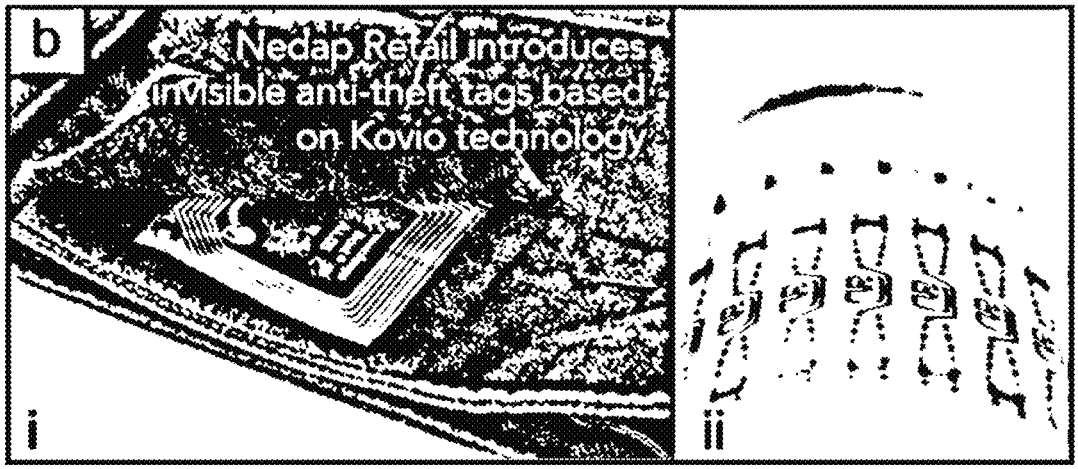
FIG. 4B shows a photograph of a flexible RFID tag made by Kovio.
Figure 4C:
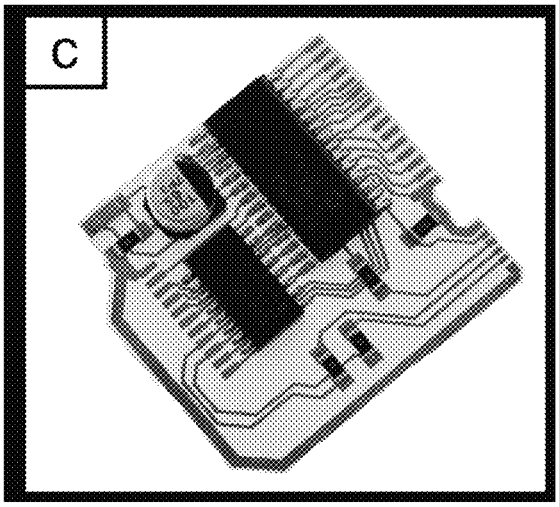
FIG. 4C shows IC components mounted to inkjet printed circuit pattern made by InkJetFlex.

Two-dimension printing of lines on flat substrates at this scale can be relevant to printing near-field communication (NFC) and radio-frequency identification (RFID) antennas with reduced area, thereby achieving a smaller form factor and reduced cost (i.e., more devices/substrate). Notable commercial technologies at the limited scales of inkjet include Kovio's anti-theft tags (FIG. 4B(i)) and InkJetFlex UHF antennas (FIG. 4B(ii)). This is also relevant to manufacturing of low-cost flexible circuits, because only "coarse features" like bus lines & connectors can be printed with inkjet. For instance, InkJetFlex prints copper circuitry on thin flexible polymer substrates with 250 μm minimum line width (FIG. 4C). Achieving finer resolution conductive traces by DPE can enable direct printing of circuit elements that require micron-sized features, such as resistors, capacitors, and transistors.

Figure 5A:
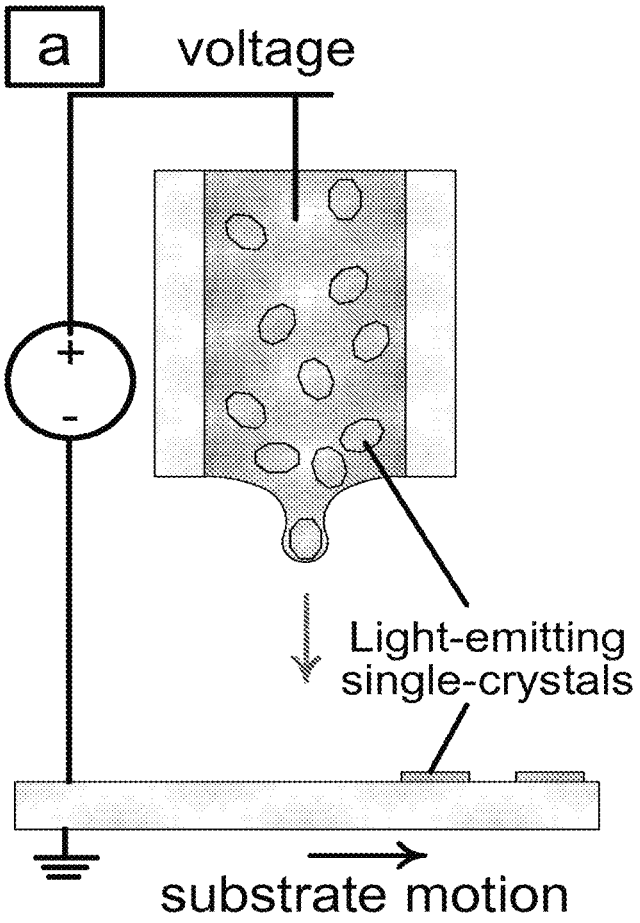
FIG. 5A shows a schematic method for DPE of pre-made organic crystals for light emission.
Figure 5B:
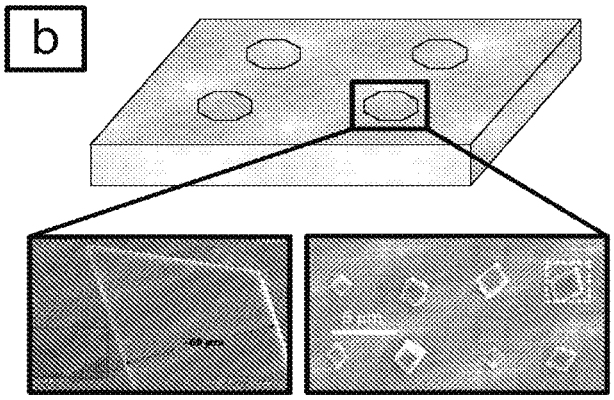
FIG. 5B shows SEM images of polydisperse crystals made by current methods. See, for example, Kim, K., et. al., 2007, Synthetic Metals, 157. pp. 481-484; Briseno, A., et. al., 2006, Nature, 444 (14), doi:10.1038/nature05427, which is incorporated by reference in its entirety.

DPE can print organic micro-crystals into discretized arrays, which can function as pixels comprising an OLED display (FIG. 5A). Organic single-crystal semiconductors exhibit high performance, in terms of light emission efficiency and color stability, and may be batch-fabricated as microscale particles with varying geometries (e.g., 1-100 μm organic "platelets", FIG. 5B). However, practical arrangement of these crystals is not possible by current (i.e., stochastic) print methods, and thus printing of OLED displays has been achieved by (1) printing droplets of comparatively lower-performance amorphous organic materials (i.e., ~$1/10^{th}$ the efficiency), or (2) printing droplets of precursor that precipitate organic crystals during evaporation, although this is difficult to control due to environmental sensitivity. See, for example, Gorter, H., et. al., 2013, Thin Solid Films, (532), 11-15, which is incorporated by reference in its entirety. The discrete print capability of DPE enables this application, and illustrates the disruptive utility of DPE as a microscale analog to mechanical pick-and-place.

In addition, DPE can scale up. DPE can identify a liquid/particle delivery and sensing/control scheme that is conducive to highly multiplexed parallel printing. Inkjet print heads may have a 10's-100's of nozzles, enabled by MEMS fabrication, in order to improve printing throughput. Parallel array print nozzles can also be used for DPE printing to enable industry-throughput scale-up.

Advantages of DPE and Examples of its Application

DPE has the ability to print any solid object from solution, which can expand the library of printable materials to include dimensionally precise dispersed micro- and nano-particles that can be integrated as discrete device elements. For example, chemically made organic micro-crystals can be digitally printed to function as individual light-emitting pixels, enabling lower-cost and higher-performance OLED displays. For these and other applications, DPE printing can be a "drop-in" replacement for inkjet, enabling simplified and lower-cost manufacturing, as well as improved device functionality.

Further, the substrate area throughput of DPE can be invariant with feature size, contrasting the area-throughput tradeoff of inkjet and other direct-write methods. This is because the mechanical time constants of capillary force phenomena, which govern the speed of particle ejection for DPE printer, scale as the inverse square of the particle radius. Thus, the number of particles required to cover a fixed substrate area, as well as the printing frequency, both may increase as the inverse square of the particle size. For example, achieving complete uniform coverage of a substrate with 10 μm versus 100 nm diameter particles may take the same amount of time, and printing of particles with different sizes (e.g., from different tips in a microfabricated tip array) does not have to decrease the area throughput.

DPE has advantages over inkjet and competing printing technologies. For example, DPE can provide deterministic printing of 0.1-100 μm matter with digital precision, where a single particle can be printed using a voltage pulse with a specific duration and profile. DPE can have compatibility with a wide range of materials including polymers, organic crystals, metals, and ceramics—virtually anything that can be dispersed in a carrier liquid. DPE can be cost-effective because operational expenditures are comparable to inkjet (no clean-room), inks, and print speed can be invariant with area throughput. DPE can have versatility and broad applicability by enabling printing of arbitrary discrete or continuous patterns, and even stacking particulates in 3D.

With DPE, printing machines and/or modules can be developed for highly integrated manufacturing operations (e.g., in the electronics and display industries); desktop printers can be developed; and particulate material formulations, including solutions of "electronic" particles, can be used for printing.

High-value applications of DPE can exist for micron-scale printing, and conductive particulate materials commercially available and currently used in inkjet printing can be printed at finer length scales enabling higher performance of printed electronics. DPE can print 1-10 μm particles visualized optically during printing. The demand for finer printed solid features spans several different industries, and the generality of the DPE approach to print solids including conductors and organic semiconductors can be complementary to the growing availability of particulate materials. In this regard, the ability to decouple feature size, shape, and chemistry from the printing process via DPE can introduce a new approach to material design for printing. Also, the "drop-in" compatibility of DPE as a direct-write method analogous to inkjet would enable its implementation in existing manufacturing operations.

DPE can be disruptive to manufacturing of flexible and organic electronics manufacturing, and can have significant potential for both commercial and scientific impact. The capabilities of DPE to print functional particulate matter can enable many potential market opportunities including further miniaturization of flexible electronic elements (wires, spirals) at lower manufacturing cost, and manufacturing of high-performance OLEDs by direct printing of crystals.

DPE can also enable heterogeneous assembly of micrometer-scale processors, memory devices, photovoltaic cells, and RFID tags. Another future area could be custom fabrication of biosensors/assays using chemically specific polymer and metallic beads. Moreover, specific arrangements of individual nm-μm sized particles on substrates can trigger nanoscale electrical and optical transport phenomena that could be integrated with semiconductor fabrication.

DPE can be a practical solution to achieve deterministic ejection of individual particles from a random dispersion. DPE can also minimize complexity by using capillary tips much larger than the particle diameter. The flow of particles can be manipulated to determine which feedback control scheme can serve to first "deliver" then "eject" particles.

DPE can achieve high accuracy placement of particles on the substrate, robust to variations due to the influence of the surrounding electromagnetic field. The flight path of ejected particles can be influenced by substrate features and previously printed particles. This occurs because particles locally modify the electromagnetic field distribution near the substrate; and the thin liquid film initially encapsulating each particle at ejection contributes a net charge on the particle that may interact with the electromagnetic field during flight. Path-correction algorithms can be implemented in printing software to modify these effects. On the other hand, local field focusing by conductive particles aids in vertical construction, and assisted in building the vertical tower shown in FIG. 6B.

Therefore DPE can represent the ultimate patterning resolution of ink printing processes, and can enable further miniaturization of printed and flexible electronic circuit elements at low manufacturing costs. It can enable printing of significantly smaller and more dimensionally precise solid features than by direct inkjet deposition, which is particularly useful in fabrication of printed integrated circuits (IC) and radio-frequency identification (RFID) tags.

Example

Figure 3A:
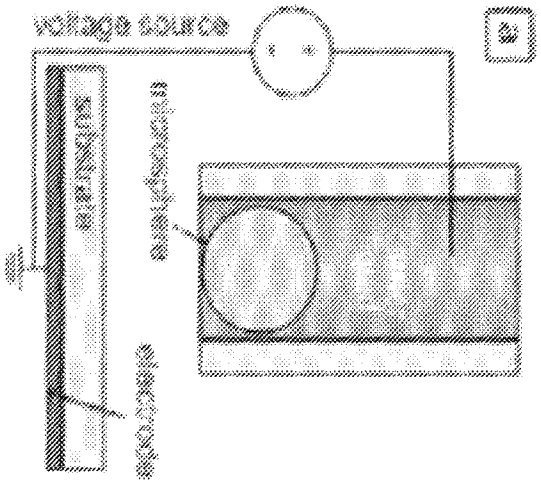
FIG. 3A shows a schematic of a DPE setup: a voltage potential is applied between the substrate and carrier liquid inside a glass capillary tip containing dispersed particles, which enables DPE printing according to FIG. 3B normal stress from accumulated electrical charge transferred to the particle through the thin liquid film (δ)
Figure 3B:
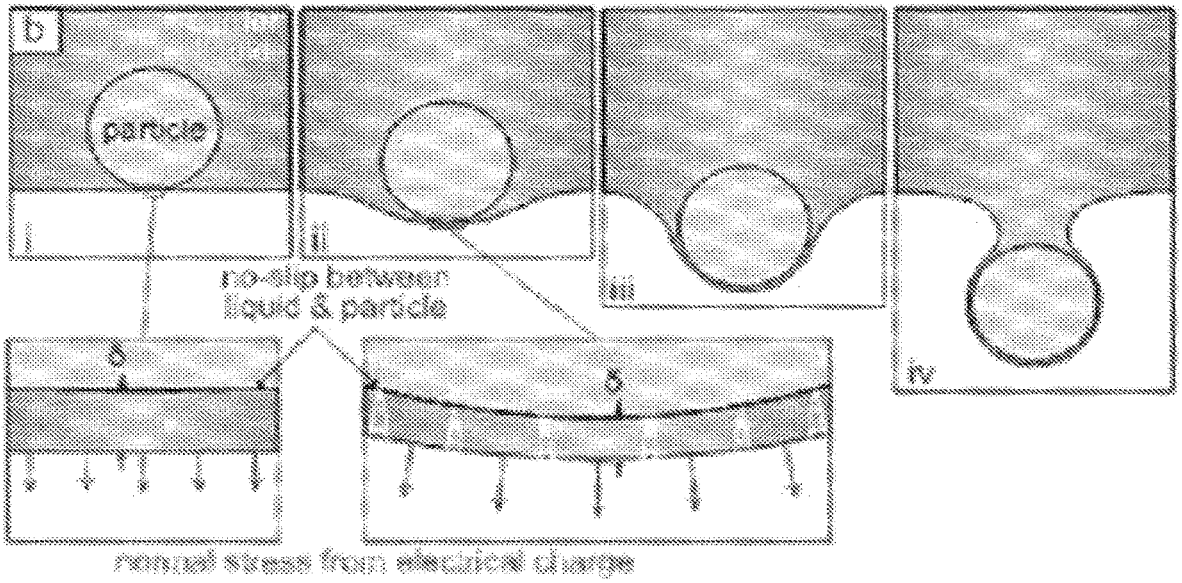
FIG. 3C shows picture of an experimental setup.
FIG. 3D shows printing of a 90 μm polystyrene sphere from a 100 μm glass capillary tip, captured with a high-speed video camera.
Figure 3C:
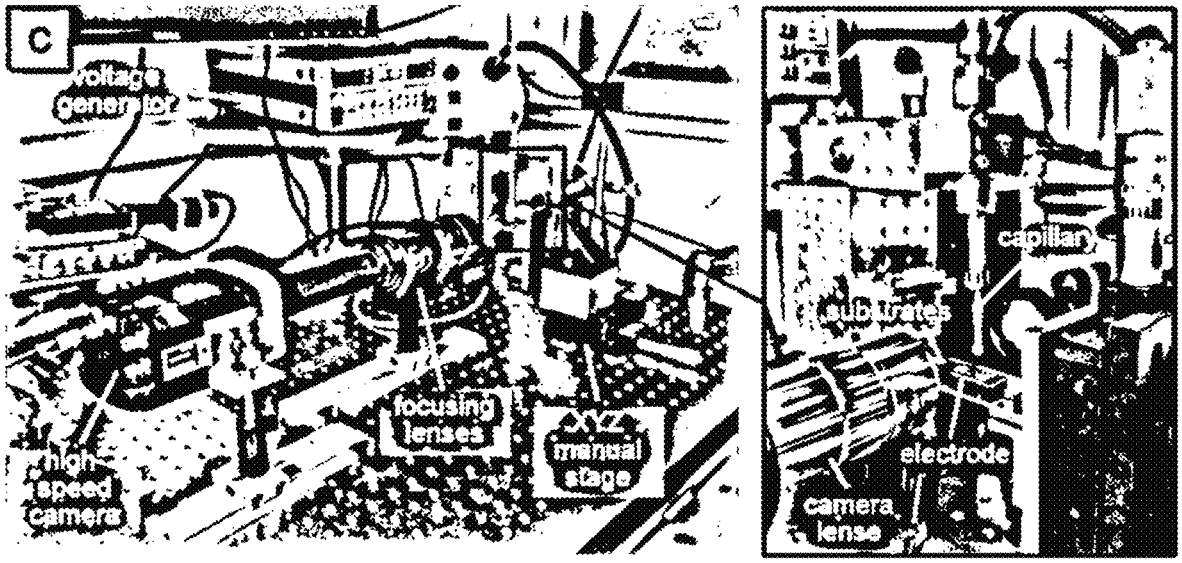
Figure 3D:
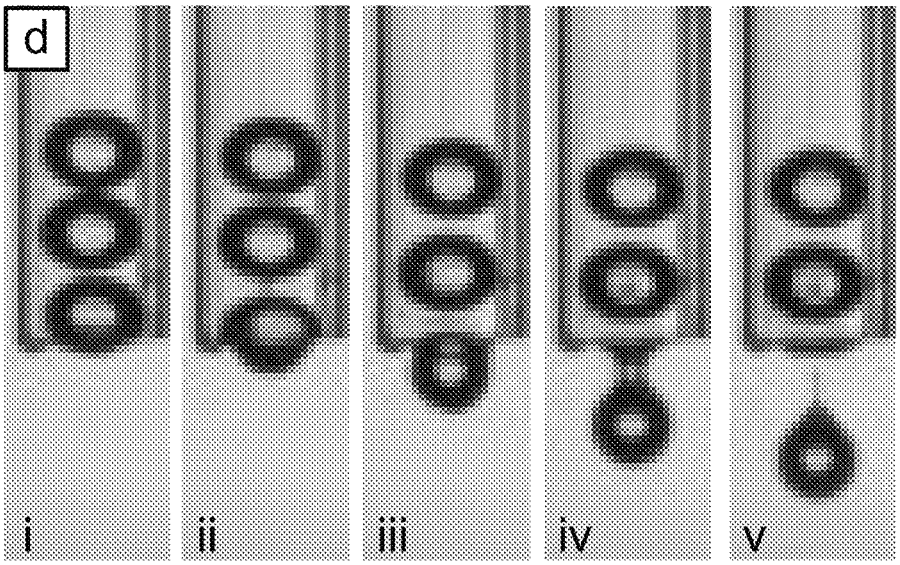

A single capillary tip apparatus for printing of microspheres dispersed in water is show in FIG. 3A and FIG. 3C. The setup consists of a cylindrical glass capillary tube filled with water, in contact with a voltage source, relative to a grounded electrode beneath the substrate. High-speed video imaging shows that individual particles can be ejected from the tip by applying a single voltage pulse to the system. In another example, 90 μm diameter polystyrene spheres were printed "single file" from a 100 μm tip (FIG. 3D).

The enabling physical principle of DPE involves the interaction between (1) the electromagnetic boundary condition at the liquid/air interface, and (2) the liquid flow boundary condition at the particle/liquid interface (FIG. 3B). First, electrical charge accumulates at the liquid/air interface by applying a voltage potential to the liquid, thereby exerting a net downward stress on the interface. Second, the relative motion of liquid molecules in contact with the particle surface are inhibited, implying that there is no slip of the liquid in the direction tangent to the particle/liquid interface. The combination of these two boundary conditions implies that, if the particle is sufficiently close to the liquid meniscus, a thin 'immobile' liquid film forms, which transfers the downward electric stress at the meniscus to the particle and enables abrupt and controllable ejection when the downward electrical force exceeds the capillary force arising from surface tension. By sensing/controlling the arrival of a particle on the liquid surface in the proper location, on-demand digital printing from the liquid can occur (FIG. 1B). DPE may print particles down to ~10 nm diameter—as this is the length scale where continuum mechanics is no longer a valid assumption, and feasibility of printing <10 nm diameter particles must be informed by molecular dynamics simulations. DPE can print particles down to ~100 nm diameter.

Figure 7:
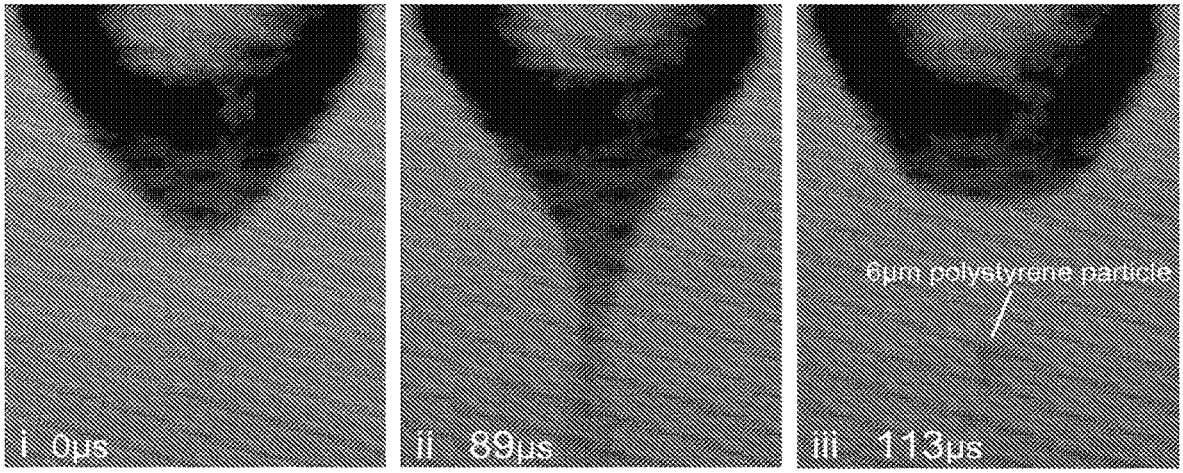
FIG. 7 are high-speed video images showing the ejection of a single 6 μm diameter polystyrene particle from a 100 μm diameter capillary tip containing hundreds of particles in dispersion (i.e., not a single-file line as in FIG. 3). The particle adheres to the substrate upon contact.

Because DPE depends on the local electrical and capillary force balance surrounding a single particle near the liquid interface, it is not necessary for the dispensing tip to be approximately the particle size, nor must the particles stack in single-file to enable printing. In FIG. 7, a voltage pulse is applied to print a single 6 μm diameter polystyrene particle from a liquid suspension containing hundreds of randomly dispersed particles. Achieving on-demand digital printing in this instance can therefore require sensing of the arrival of a particle on the liquid surface near the apex of the meniscus, and subsequent controlled ejection of the particle.

Figure 6A:
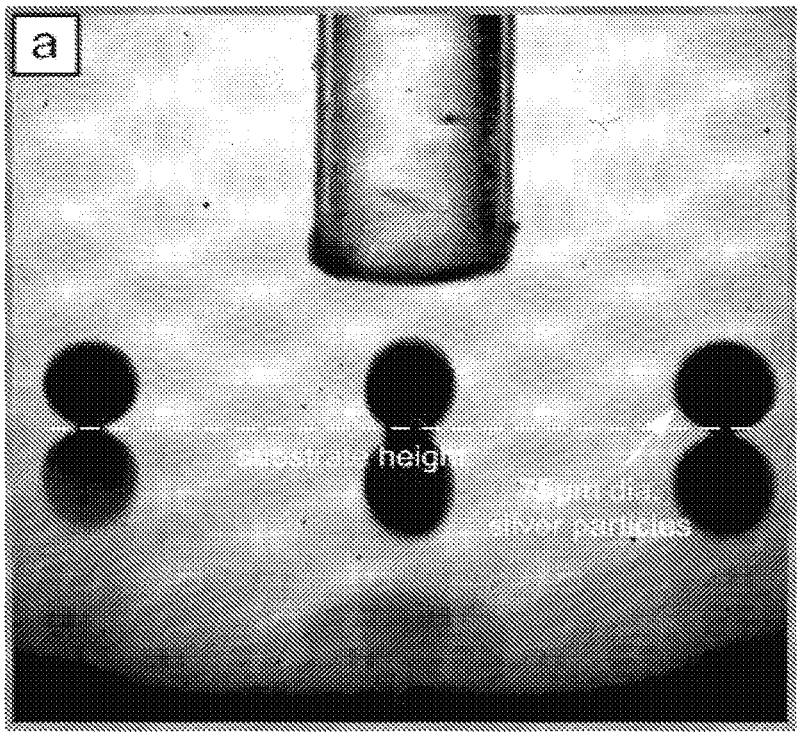
FIGS. 6A and 6B show printing of silver-coated microspheres (75 μm diameter) (a) in a line with equal spacing and (b) in a tower (7 particles high). Mirror images are visible due to reflection from the copper substrate.
Figure 6B:
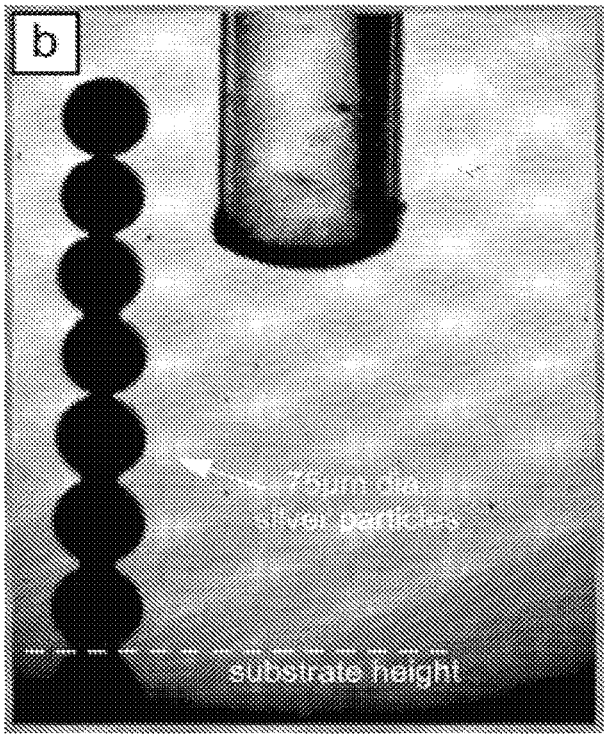

Rows of individual 75 μm diameter metallic (Ag-coated) particles with 1 mm spacing can be printed onto a copper substrate, three of which are depicted in FIG. 6A. This is not possible by commercial print methods because inkjet, as well as other current print technologies, are inherently stochastic.

3D structures can be printed. For example, a vertical tower made from seven 75 μm diameter metallic (Ag-coated) particles, ejected individually and sequentially, can be constructed. Such a structure is not possible by inkjet, stamp imprint, or xerography, and shows the potential to build novel 3D device architectures from the same material, or possibly from different materials ejected from different tips in a programmed sequence.

Figure 8:
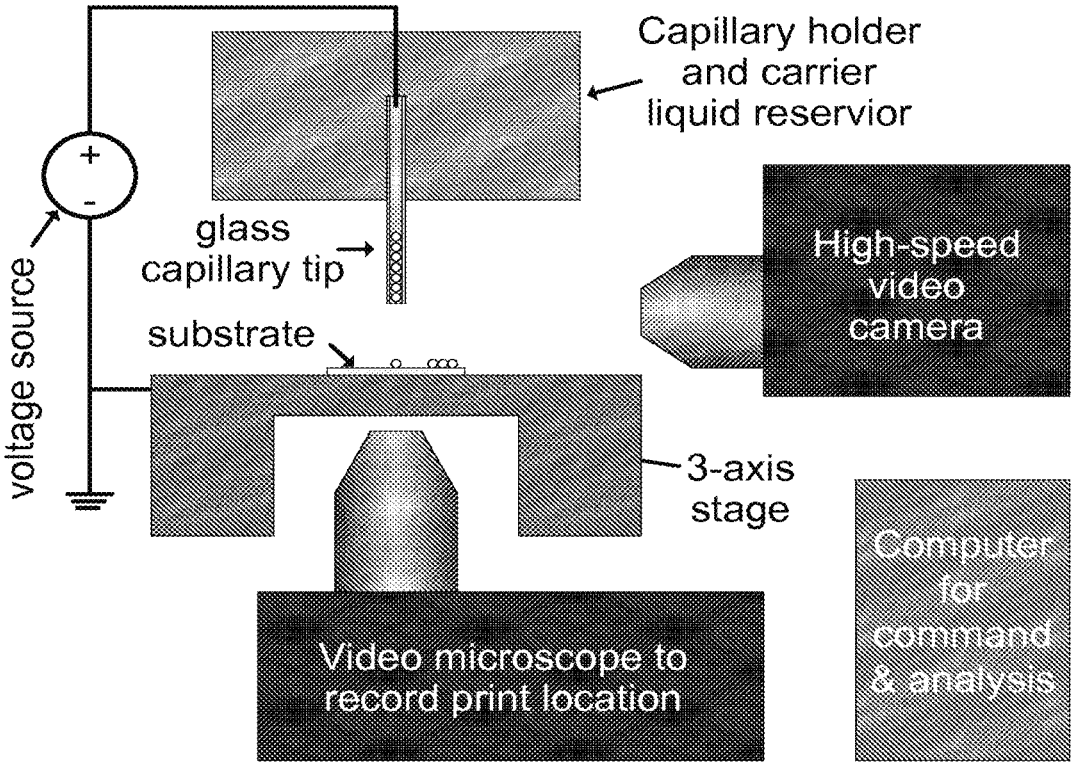
FIG. 8 shows a schematic of setup of DPE particle ejection of 0.1-100 μm particles.

FIG. 8 shows a schematic of setup of DPE printing of 0.1-100 μm particles. The liquid dynamics at the capillary tip orifice, as well as the particle flight path can be monitored and recorded, and printing can be controlled with high-speed electronics.

In FIG. 8, the liquid contains particles that can have a size of 0.1-100 μm. The particles can exit through an orifice, such as the tip of a capillary, and be printed onto a substrate. A voltage source can be applied near the orifice, for example between the liquid and the substrate, which can be on a surface of a 3-axis stage. A high-speed video camera can be used to record images of the printing process. A video microscope can be used to record print location. A sensor can be used to sense an electromagnetic boundary condition and a liquid flow boundary condition by detecting the location of the particle near the apex of a meniscus of the liquid at the orifice. A computer can be used for command and analysis. For example, the computer can command the application of a voltage pulse between the orifice and a substrate for timed particle ejection based on the sensed electromagnetic boundary condition and the sensed liquid flow boundary condition to deposit the particle onto a surface of the substrate after applying the voltage pulse.

DPE particle ejection can be controlled. Control strategies can comprise (1) a physical system configuration, and (2) a control loop algorithm. Exemplary schematics are shown in FIGS. 9A-9C, FIGS. 10A-10B and FIGS. 11A-11B, and other embodiments are also conceivable to those skilled in the art.

Figure 9A:
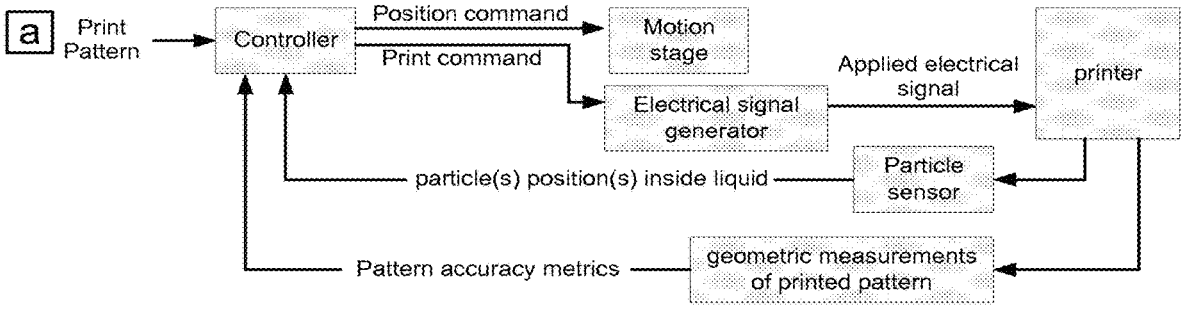
FIGS. 9A-9C depict a control strategy of DPE particle ejection.
Figure 9B:
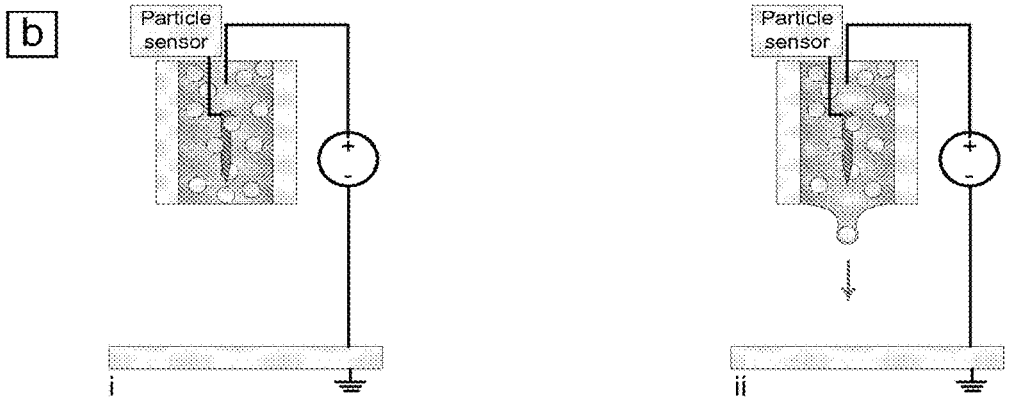
Figure 9C:
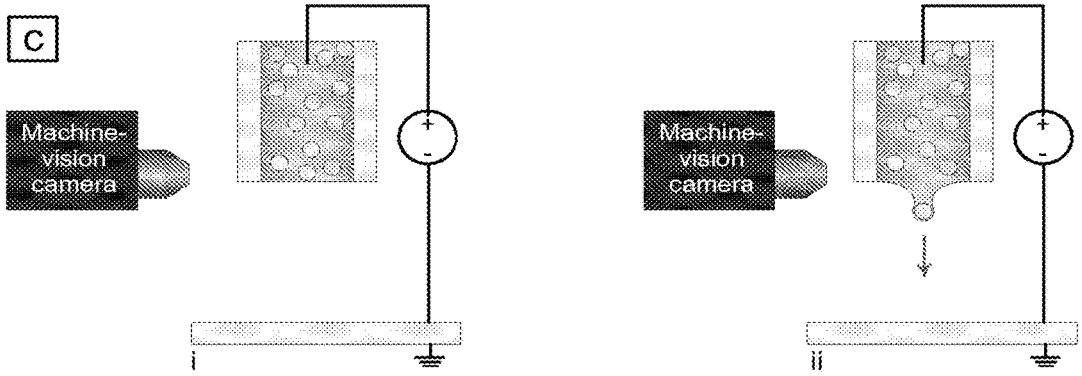
Figure 10A:
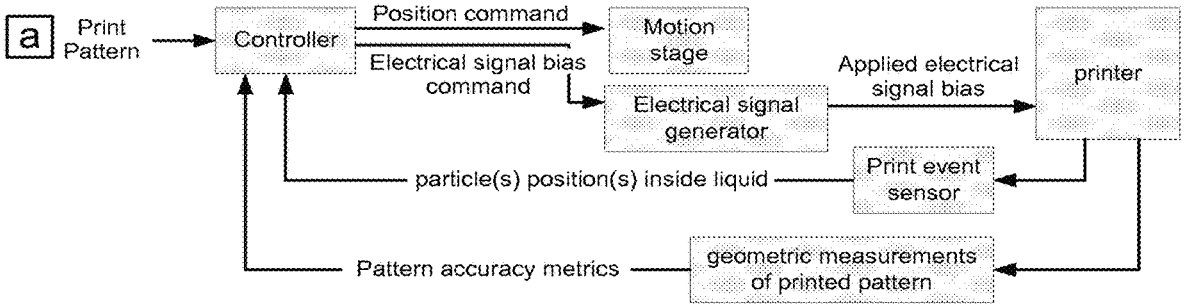
FIGS. 10A-10B depicts a control strategy of DPE particle ejection.
Figure 10B:
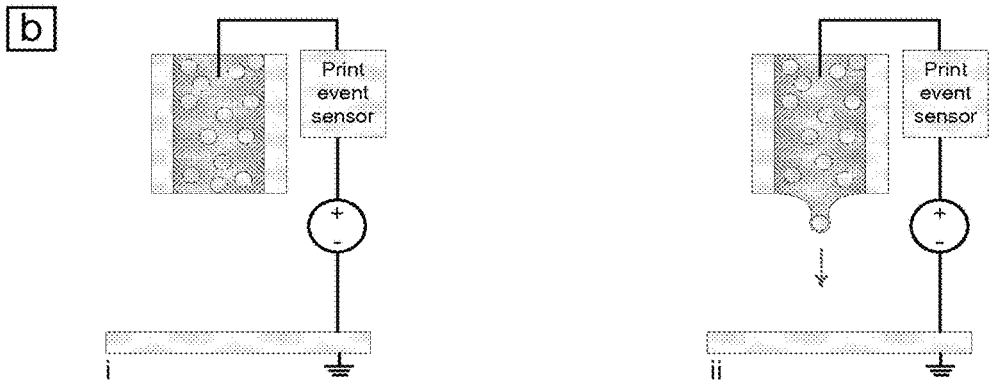

FIGS. 9A-9C depicts a control strategy that relies on real-time feedback of the particle position within the liquid by a "particle sensor" (FIG. 9A). This sensor may be, for instance, a particle sensing probe (FIG. 9B) or machine-vision camera (FIG. 9C). Here, the particle sensor indicates to the controller when a particle is in the proper location near the liquid meniscus (FIG. 9B(i), FIG. 9C(i)). The controller responds by sending a print command to a signal generator, which outputs an electrical signal pulse to eject the particle (FIG. 9B(ii), FIG. 9C(ii)). The motion stage repositions the substrate accordingly. Metrics related to the accuracy of the printed pattern may also be recorded by a device such as a secondary video microscope, and fed back to the controller if necessary for adjustment of process parameters affecting particle trajectory and substrate registry.

"Passive" control strategies may also be implemented, in which a constant-bias electrical signal (AC or DC) is applied to the liquid, which induces predictable periodic ejection of individual particles. The control loop algorithm differs in this example because a "print event sensor", such as a sensitive high-speed voltmeter or ammeter in series with the signal generator (FIGS. 10A and 10B), informs the controller when a particle has been released. The controller then reacts to the print event by updating the motion stage position accordingly. This control strategy may be beneficial for ultra-fast printing that occurs faster than the timescale of a controlled electrical signal pulse, as in FIGS. 9A-9C.

Figure 11A:
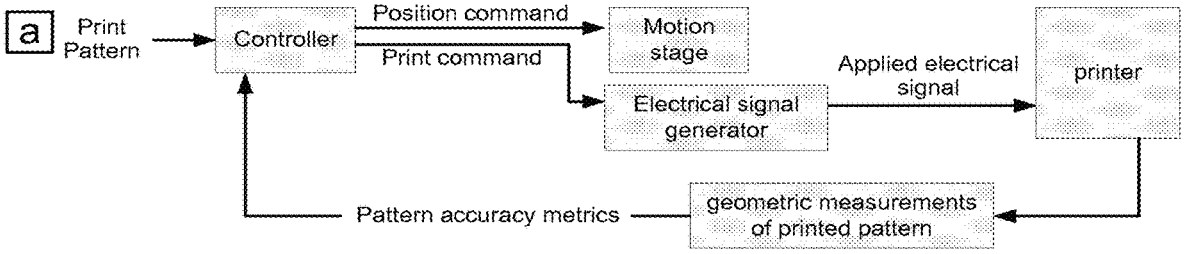
FIGS. 11A-11B depicts a control strategy of DPE particle ejection.
Figure 11B:
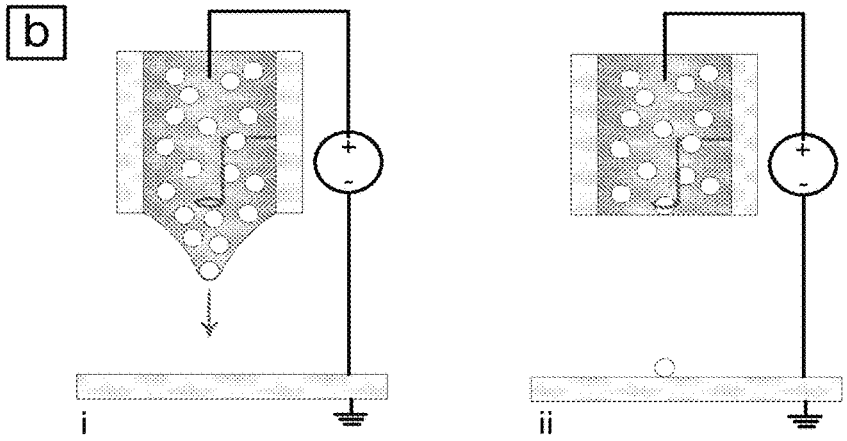

Physical entrapment control strategies may also be utilized, such as that depicted in FIGS. 11A and 11B. In this example, an electrical signal pulse is applied to eject a single particle (FIG. 11B(i)). Afterwards, the retraction of the liquid meniscus forces a flow of particles around a mechanical constraint, ensuring that a single particle is trapped and correctly positioned for the next commanded ejection (FIG. 11B(ii)). The control loop algorithm in this example may not require particle sensing. There are potential cost savings with this control strategy because the printer may essentially run "open-loop".

These control strategy examples demonstrate the versatility of DPE to adapt to a wide range of industry applications with varying performance/functional requirements.

Other embodiments are within the scope of the following claims.

What is claimed is:

1. A method of delivering a particle comprising:

providing a liquid including a particle to an exit orifice;

ejecting only a single particle from a meniscus of the liquid_by applying an electromagnetic signal near the orifice for timed particle ejection based on a sensed condition to deliver the particle from the orifice after applying the electromagnetic signal.

2. The method of claim 1, wherein the electromagnetic signal is AC or DC.

3. The method of claim 1, wherein the electromagnetic signal is constant or varying.

4. The method of claim 1, further comprising applying an electromagnetic signal pulse.

5. The method of claim 1, wherein a single particle is specifically printed.

6. The method of claim 1, wherein the particle is a solid.

7. The method of claim 1, wherein the particle includes polymer.

8. The method of claim 1, wherein the particle includes metal or semiconductor material.

9. The method of claim 1, wherein the particle includes ceramic.

10. The method of claim 1, wherein the particle includes an organic crystal.

11. The method of claim 1, wherein the particle is conductive.

12. The method of claim 1, wherein the orifice exposes a liquid meniscus from which a particle is ejected.

13. The method of claim 1, wherein the particle is at a liquid meniscus at the orifice when the particle is ejected from the orifice.

14. The method of claim 1, further comprising delivering of a particle to an apex of a liquid meniscus at the orifice prior to ejecting the particle from the orifice.

15. The method of claim 1, further comprising annealing the particle.

16. A device of delivering a particle comprising:

an orifice;

a liquid reservoir for delivering a particle to the orifice; and an electromagnetic supply configured to generate an electromagnetic field near the orifice to eject only a single particle from a meniscus of the liquid based on an electrical boundary condition and/or a liquid flow boundary condition by an apex of the meniscus of the liquid at the orifice.

17. The device of claim 16, wherein the device includes an array of print nozzles.

18. The device of claim 16, wherein the device prints particles of different sizes.

19. The device of claim 16, wherein the device prints particles of different materials.

20. The device of claim 16, wherein the orifice is one of an array of nozzles fluidly connected to the liquid reservoir.

* * * * *